US005392569A

United States Patent [19]

Stickle

[11] Patent Number: 5,392,569

[45] Date of Patent: Feb. 28, 1995

[54] EDGER SANDING TOOL

[76] Inventor: Dean Stickle, 9820 Berry Road, Richmond, British Columbia, Canada, V7A 2M8

[21] Appl. No.: 114,518

[22] Filed: Sep. 1, 1993

[51] Int. Cl.[6] ..... B24D 15/00

[52] U.S. Cl. ..... 51/523; 451/502; 451/495; 451/514; 451/520

[58] Field of Search ..... 51/358, 363, 370, 371, 51/382, 383, 388, 391, 392, 393

[56] References Cited

U.S. PATENT DOCUMENTS

| | | | |
|---|---|---|---|
| 618,008 | 1/1899 | Hoerner | 51/386 |
| 2,753,669 | 7/1956 | Larson | 51/187 |
| 3,714,743 | 11/1971 | Hall | 51/392 |
| 4,845,901 | 7/1989 | Hamlin | 51/391 |
| 4,882,953 | 11/1989 | Kalka | 76/83 |
| 4,964,243 | 10/1990 | Reiter | 51/180 |

*Primary Examiner*—Maurina T. Rachuba
*Attorney, Agent, or Firm*—Norman M. Cameron

[57] ABSTRACT

One aspect of the invention provides a sanding tool including a first rigid member having a first planar surface. There is an elongated groove along the surface which receives an edge of a sheet of sandpaper. The sandpaper is supported by a second rigid member with a second surface which extends along the groove outwardly from the first planar surface. Another aspect of the invention provides a sanding tool with a first rigid member having a first planar surface. A plurality of nesting members are received on the first surface. Each nesting member has a sandpaper receiving, partly cylindrical surface extending outwardly from the first surface. At least one outer nesting member is removable to expose the partly cylindrical surface of another radially inward nesting member.

6 Claims, 3 Drawing Sheets

EDGER SANDING TOOL

BACKGROUND OF THE INVENTION

1. Field of the Invention

This invention relates to tools for sanding edges, particularly edges of furniture, cabinets and interior trim.

2. Description of Related Art

Sanding tools, also referred to as sanding blocks, commonly consist of a member with a flat surface for receiving the back side of a sheet of sandpaper and a clamp for securing the sheet of sandpaper to a tool. These tools are well adapted for sanding most flat surfaces. However, a problem is encountered when they are employed to sand the edges of furniture, counters and interior trim where the edges must be precisely at right angles with another surface, usually the top of the counter or furniture for example.

For this reason, special sanding tools have been devised for sanding such edges. An example is found in U.S. Pat. No. 3,714,743 to Hall where the sanding tool is provided with rollers intended to ride on the surfaces perpendicular to the edges. The purpose of the rollers is to keep the edges perpendicular to the surfaces as they are sanded. The sandpaper in the Hall device appears to extend inwardly beyond the corner formed by the roller and the flat, sandpaper receiving surface of the tool. However, considerable force is often exerted on such sanding tools during use. A tool such as described by Hall may not ensure a completely square corner because of flexibility in the shafts of the rollers and play between the rollers and the shafts. This effect is exacerbated by the angle of the handle so pressure on the handle tends to change the angle between the roller and the block surface. Furthermore, the tool is relatively complicated compared to many sanding tools because it requires many additional components including mounting shafts, rollers and tool is considerably more expensive to produce than a standard sanding block.

Tools having an abrasive receiving surface and a guide surface meeting at a set angle are also known as seen, for example, in U.S. Pat. No. 4,845,901 to Hamlin. Here however the strip of sandpaper extends only to the corner between the two surfaces. The edge of the sandpaper is prone to wear and tearing and therefore such tools cannot ensure a good sanding job right to the corners between the edges and the surfaces adjacent thereto.

SUMMARY OF THE INVENTION

It is an object of the invention to provide an improved sanding tool which is capable of sanding edges while keeping the edges at a set angle in relation to an adjacent surface.

It is also an object of the invention to provide an improved tool for sanding edges which is simple in construction and therefore economical to produce and sell.

It is also an object of the invention to provide an improved sanding tool for edges which is rigid in construction so that the edges may be kept at a set angle with respect to the adjacent surfaces even when hard pressure is applied to the sanding tool during use.

It is a further object of the invention to provide an improved edge sanding tool which is capable of sanding curved edges.

It is a still further object of the invention to provide an improved sanding tool capable of sanding rounded edges having different radiuses.

In accordance with these objects, one aspect of the invention provides a sanding tool which includes a first rigid member having a first planar surface with means for receiving an edge of a sheet of sandpaper. The means includes an elongated groove along the surface. There is means for supporting the sheet of sandpaper with an abrasive surface facing outwardly. The means for supporting includes a second rigid member with a second surface extending along the groove outwardly from the planar surface.

Another aspect of the invention provides a sanding tool comprising a first rigid member and a second rigid member. Each rigid member has a fiat, planar surface. The second member has a back on a side thereof opposite the surface thereof. The surfaces intersect at a right angle to form a straight inside corner. The first member has a groove therein extending along the corner. A sheet of sandpaper extends over the surface of the second member and has an edge thereof extending into the groove below the surface of the first member. There is a clamp connected to the back of the second member which secures the sandpaper thereto.

Another aspect of the invention provides a sanding tool with a first rigid member having a first planar surface. A plurality of nesting members are received on the first surface. Each said nesting member has a sandpaper receiving, partly cylindrical surface extending outwardly from the first surface. At least one outer said nesting member is removable to expose the partially cylindrical surface of another radially inward said nesting member. The first member may have a plurality of radially spaced-apart, circularly curved grooves therein. The cylindrical surface of each of the nesting members is adjacent to one of the grooves.

DESCRIPTION OF THE PREFERRED EMBODIMENTS

Figure 1:
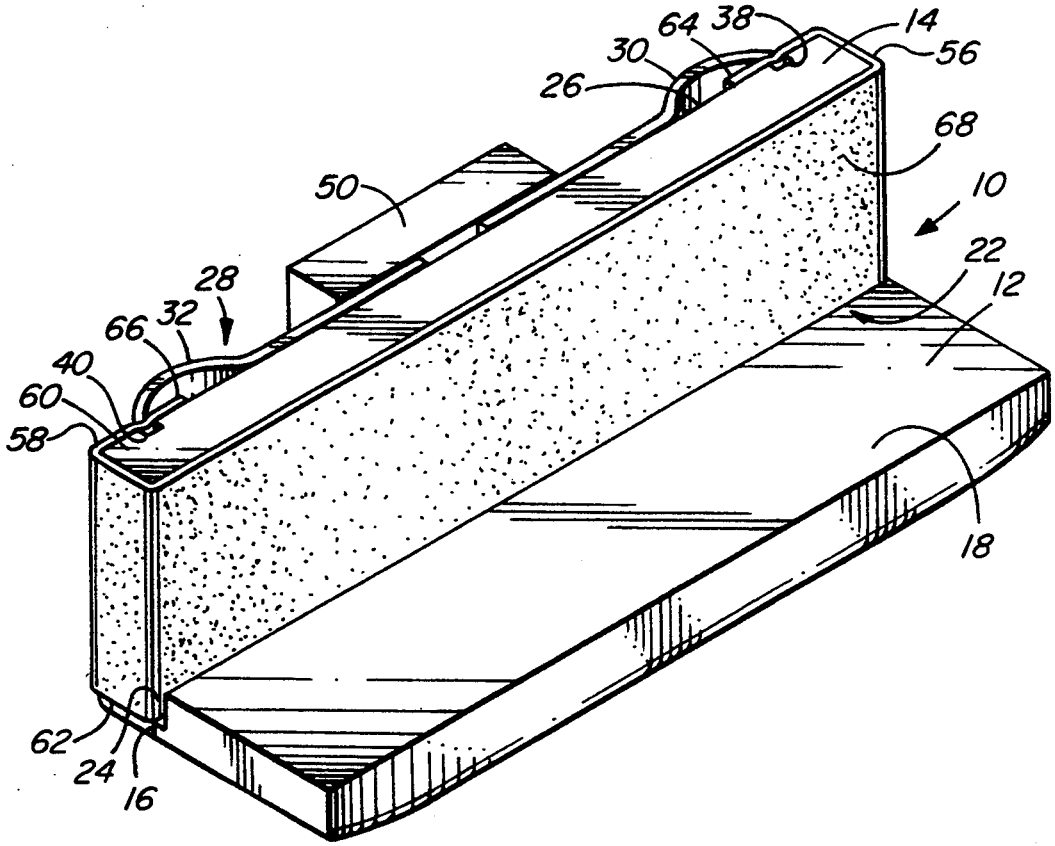
FIG. 1 is a top, front isometric view of a sanding tool according to a first embodiment of the invention.
Figure 2:
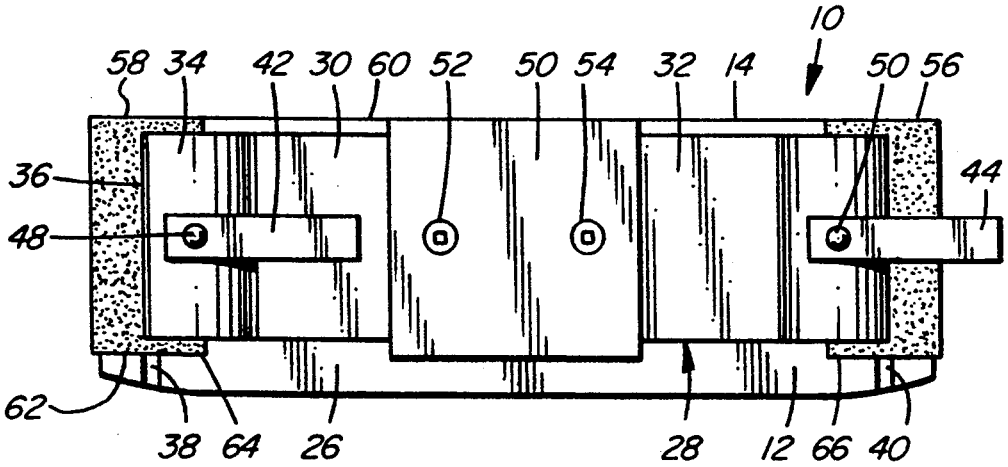
FIG. 2 is a rear elevation thereof.
Figure 3:
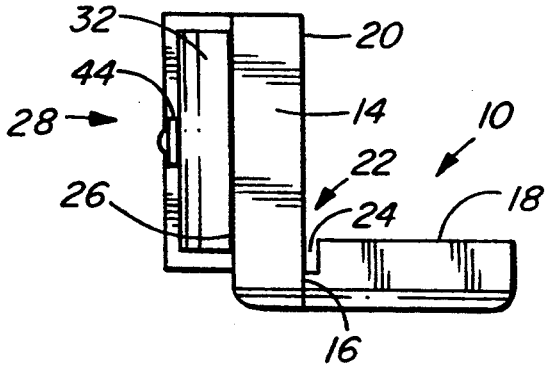
FIG. 3 is a end view thereof.

Referring first to FIG. 1–3, these show a sanding tool 10 which is designed for sanding edges of cabinets, furniture or the like which extend at right angles from flat, typically horizontal surfaces. The tool 10 includes a first member 12 and a second member 14. Each of the members is a wooden block in this embodiment. A hardwood is preferred for durability, oak being used in this example. The members are connected together by an adhesive along joint 16 shown in FIG. 1 and 3. Alternatively the two members could be formed out of a single piece of wood or other material such as a plastic or metal could be substituted. The two members form an L-shaped configuration in section as seen in FIG. 3.

Member 12 has a flat, planar surface 18 while member 14 has a similar surface 20. It may be seen that the surfaces 18 and 20 are perpendicular to each other in this embodiment. The surfaces intersect at a right angle corner 22 as seen in FIG. 1 and 3.

There is an elongated slot or groove 24 in the surface 18 of member 12 which extends along the corner 22 as seen in FIG. 1 and 3. The groove is located such that surface 20 extends below surface 18 as seen in FIG. 3. The term "below" in this context refers to positions located inwardly on member 12 with respect to the planar surface 18.

Member 14 has a back 26 located on the side thereof opposite surface 20. A clamping device 28 is connected to the back of member 14. The clamping device includes a pair of leaf springs 30 and 32 best seen in FIG. 1 and 2. Referring to leaf spring 30, the spring is generally rectangular and is curved outwardly away from back 26 of member 14. A portion 34 at the end is curved like a partial cylindrical shell with an end 36 thereof resiliently biased against back 26 of member 14. There is a slot 38 along the back of the member 14 which is located along edge 36. Leaf spring 32 is the same as leaf spring 30 and therefore is not described in detail. There is a similar slot 40 for leaf spring 32 which corresponds to slot 38.

The clamps 30 and 32 are equipped with handles 42 and 44 which are formed by flat, relatively rigidly bars of metal in this example as seen in FIG. 2. The handles are rotatably connected to the respective leaf springs by rivets 48 and 50 in this example. The handles may be rotated outwardly to the position shown for handle 44 in FIG. 2 in order to raise the leaf spring 32 away from back 26 of member 14. When not in use, the handles are rotated inwardly to the position shown for handle 42 in FIG. 2.

The leaf springs are connected to the back 26 of member 14 by a block 50, of wood in this example, which is secured to the back by means of a pair of screws 52 and 54 which also pass through corresponding apertures in the leaf springs. Accordingly, the inner ends of each of the leaf springs are effectively sandwiched between the block 50 and the back 26 of the member 14.

FIG. 1 and 2 show a sheet 56 of sandpaper mounted on the tool. The sheet is supported by member 14, particularly its surface 20, and by the clamping device 28. The sandpaper has an upper edge 58 trimmed to generally fit about top 60 of member 14. The sheet of sandpaper has a bottom edge 62 which extends into the groove 24 below the surface 18 of the member 12 as seen in FIG. 1. The sandpaper sheet is wrapped around the member 14 so its two ends 64 and 66 are tucked beneath leaf springs 30 and 32 respectively. End 36 of leaf spring 30 and the corresponding end of leaf spring 32 tend to push the sandpaper into the slots 38 and 40, therefore securing the sandpaper in position.

As seen in FIG. 1, the sheet 56 of sandpaper has an outwardly facing abrasive surface 68 used for sanding the edges of the furniture, counters or other such items. Surface 18 of member 12 slides along the perpendicular surface adjacent to the edger and acts as a guide to keep the edge exactly at right angles to the surface as it sanded. The recessing of bottom edge 62 of the sandpaper in groove 24 ensures proper sanding right to the very corner between the edge and surface. This would not occur if the edge of sandpaper were only against the corner because the edge would be subject to premature wear, tearing and the like and in general would not exactly fit along the corner 22.

Figure 4:
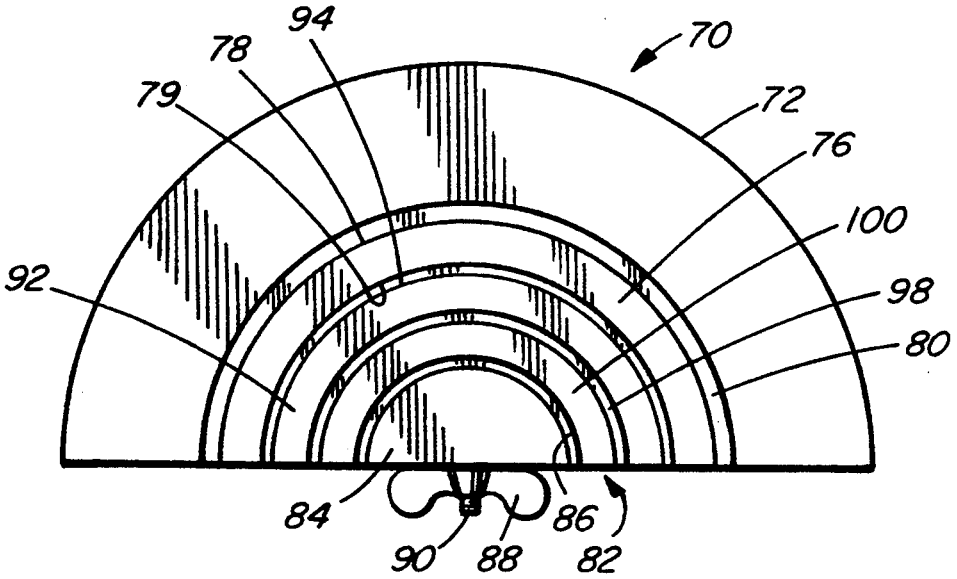
FIG. 4 is a plan view of a sanding tool according to a second embodiment of the invention.
Figure 5:
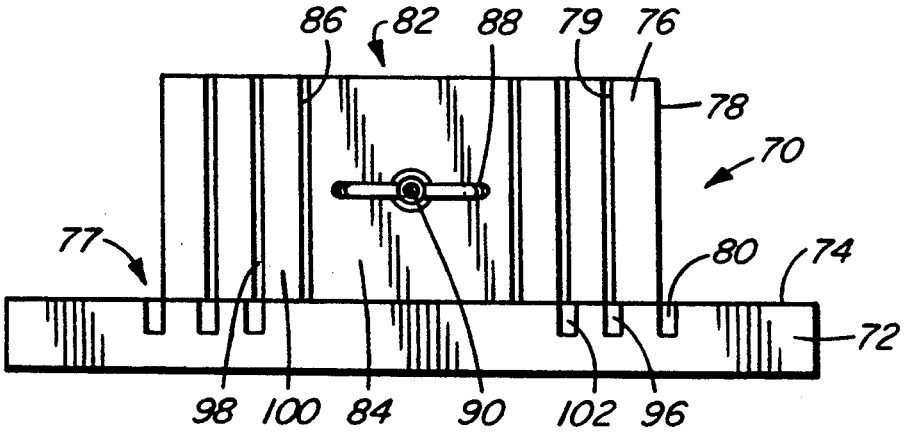
FIG. 5 is a rear elevation thereof.
Figure 6:
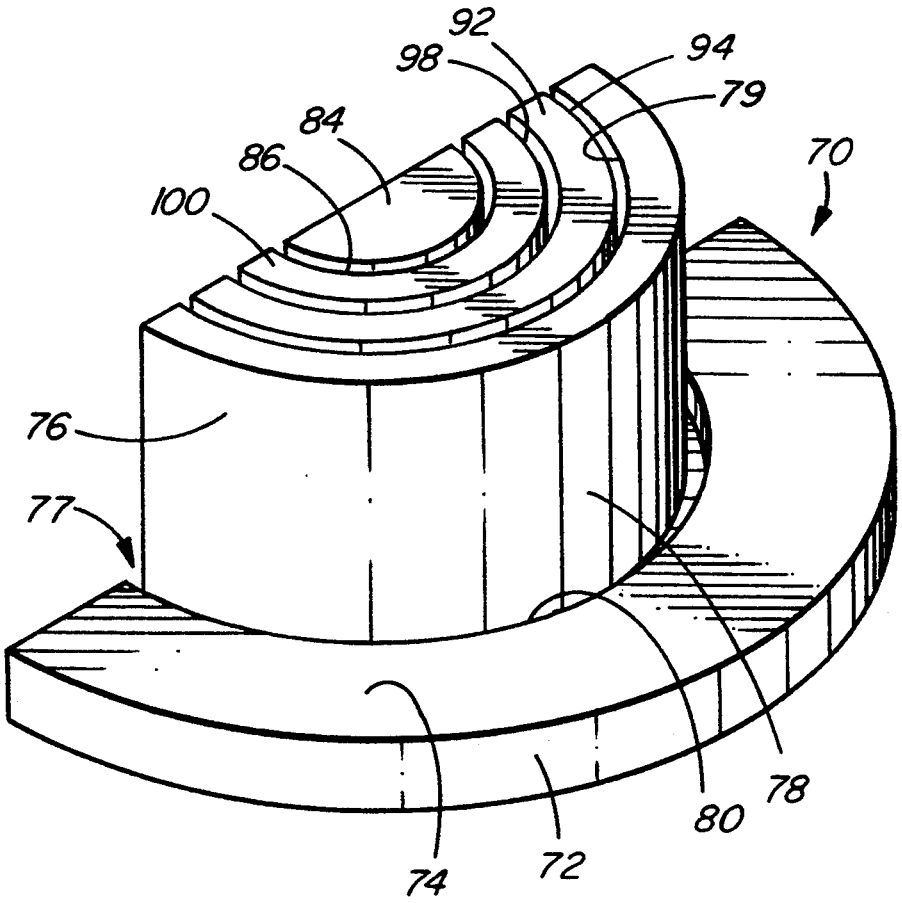
FIG. 6 is a top, front isometric view of the embodiment of FIG. 4 and 5.

An alternative embodiment of the invention is shown in FIG. 4–6. This embodiment is intended for the sanding of concavely curved edges which are adjacent to flat, planar surfaces extending perpendicularly therefrom. In this embodiment tool 70 has a first member 72 which is again of a rigid material, wood being used in this example. The first member has a first planar surface 74. As seen best in FIG. 4, the member 70 is semi-circular although the shape of the outer edge is not critical for proper operation of the tool.

There is a second member 76, best seen in FIG. 6, which is C-shaped. The member has a sandpaper receiving, partly cylindrical, convex surface 78 on the outer side thereof. There is an inner side 80 which is also semi-cylindrical, but concave in shape and having a smaller radius of curvature than surface 78. The member 76 is of wood in this embodiment, though again other materials such as plastics could be substituted. As best seen in FIG. 5, the surface 78 intersects surface 74 at a right angle corner 77. There is a semi-circular groove 80 along surface 74 of member 72 which extends along the corner 77. The groove serves the same purpose as groove 24 of the embodiment of FIG. 1. A strip of sandpaper can be wrapped about surface 78 of member 76 with the bottom edge thereof projecting into the groove 80 so it is recessed below the surface 74. The sandpaper can then be used to sand a concavely curved edge having the same radius of curvature as the surface 78. The sandpaper is wrapped around the member 76 and the ends of the sandpaper can be secured at the back of tool 70 by clamp 82. The clamp consists of a semi-cylindrical member 84 which is releasably secured against concave, semi-cylindrical surface 86 by a wing nut 88 fitted on threaded stud 90. The member 84 is removed or loosened and the ends of the sandpaper fitted between the member and the surface 86. The wing nut is then tightened to hold the ends of the sandpaper in place.

The tool 70 has three nesting members, each providing a different radiused surface for receiving the sandpaper depending upon the radius of the edge to be sanded. Member 92 is similar in shape to member 76, but has a reduced radius. It has a semi-cylindrical, convex outer surface 94 which can receive the sandpaper if member 76 is removed. There is a groove 96, also semi-circular in shape, which serves to receive the edge of the sandpaper in place of groove 80 when the sandpaper is supported by surface 94.

Even smaller radiused concave edges can be sanded by removing member 92, thus exposing semi-cylindrical, convex surface 98 of member 100. Unlike members 76 and 92, however, member 100 is fixedly connected to member 72, by a suitable adhesive in this example. The stud 90 extends slidably through an aperture (not shown) in member 84 and is rigidly secured in member 100. Groove 102, shown best in FIG. 5, receives the bottom edge of the sandpaper when surface 98 is employed.

Variations and Alternatives

Sanding tools according to the invention are not limited to use for edges which are at right angles to the adjacent surface as in the case of the illustrated embodiments. For example, the tool 10 of FIG. 1 could be adapted for other angles by mounting member 14 at a different angle with respect to member 12 than the right angle shown in FIG. 3. Moreover, the angle may be made adjustable by mounting member 14 on a hinge connected to member 12. Wing nuts or other tightening means can be employed to hold the two members at any required angle.

The clamping device 28 of FIG. 1–3 and the clamp 82 of FIG. 4–6 may be replaced with other types of clamps to hold the sandpaper.

The embodiment of FIG. 4–6 may employ a greater or smaller number of nesting C-shaped members than the illustrated three members.

It will be understood by someone skilled in the art that many of the details provided above are by way of example only and can be varied or deleted without departing from the scope of the invention which is to be interpreted With reference to the following claims:

What is claimed is:

1. A sanding tool comprising:

a first rigid member having a first planar surface; and a plurality of nesting members received on the first surface, each said nesting member having sandpaper receiving, partly cylindrical surface extending outwardly from the first surface, at least one outer said nesting member being removable to expose the partly cylindrical surface of another radially inward said nesting member.

2. A tool as claimed in claim 1, wherein the first member has a plurality of radially spaced-apart, circularly curved grooves therein, the cylindrical surface of each of the nesting members being adjacent to one of the grooves.

3. A tool as claimed in claim 1, wherein an innermost said nesting member is rigidly secured to the first member.

4. A tool as claimed in claim 3, wherein the innermost nesting member has a sandpaper clamp on a side thereof opposite the partly cylindrical surface thereof.

5. A tool as claimed in claim 1, wherein each of the nesting members is C-shaped in section.

6. A sanding tool comprising a first rigid member and a second rigid member, each said member having a flat, planar surface, the second member having a back on a side thereof opposite said surface thereof, the surfaces intersecting at a right angle to form a straight inside corner, the first member having a groove therein extending along the corner; a sheet of sandpaper extending over the surface of the second member and having an edge thereof extending into the groove below the surface of the first member; and a clamp connected to the back of the second member securing the sandpaper thereto.

* * * * *